US005402541A

United States Patent [19]

Schmidt

[11] Patent Number: 5,402,541

[45] Date of Patent: Apr. 4, 1995

[54] BATHTUB LIFTING APPARATUS

[75] Inventor: Peter Schmidt, Argenbühl/Eisenharz, Germany

[73] Assignee: Schmidt & Lenhardt GmbH & Co. oHG, Germany

[21] Appl. No.: 197,640

[22] Filed: Feb. 16, 1994

[30] Foreign Application Priority Data

Mar. 5, 1993 [EP] European Pat. Off. ..... 93103522

[51] Int. Cl.[6] ..... A47K 3/12

[52] U.S. Cl. ..... 4/566.1

[58] Field of Search ..... 4/560.1–566.1, 4/579

[56] References Cited

U.S. PATENT DOCUMENTS 3,419,044 12/1968 Daniels et al. ..... 4/566.1 X
3,545,013 12/1970 Discoe ..... 4/563.1
4,419,776 12/1983 Schmidt ..... 4/564.1
4,574,408 3/1986 Dentler et al. ..... 4/560.1
4,932,087 6/1990 Schmidt ..... 4/560.1

FOREIGN PATENT DOCUMENTS 5-115528 5/1993 Japan ..... 4/560.1

*Primary Examiner*—Charles E. Phillips
*Attorney, Agent, or Firm*—Nataro & Michalos

[57] ABSTRACT

The lift platform (16) of a lifting apparatus (10) can be raised and lowered by a hydraulically operated lifting device (12) . The back rest (18) can be swivelled backwards and forwards by a swivelling device (19). A multi-valve housing (20) is connected via pressure lines (24, 26) to the lifting and swivelling devices (12, 19). A hydraulic water supply line (22) feeds hydraulic water to the multi-valve housing (20) . The multi-valve housing (20) contains main valves for filling or emptying the lifting and swivelling devices (12, 19). The multi-valve housing (20) is triggered by an external manual control unit (30) via a flexible multiple line (28) .

10 Claims, 6 Drawing Sheets

BATHTUB LIFTING APPARATUS

BACKGROUND OF THE INVENTION

The invention relates to a lifting apparatus for handicapped persons useful for insertion in a bathtub, comprising a bottom frame, a lift platform, a guide frame connecting the lift platform to the bottom frame, and an hydraulic lifting device with valve means, with a back rest pivotably disposed on said lift platform, and an hydraulic swivelling device engaging in said back rest.

PRIOR ART

A lifting apparatus is known from EP-C-0347652, in which a manually operated valve is mounted beneath the lift platform, with the control lever passing through a slot in the lift platform and protruding upwards over the seat. The valve means is attached to an hydraulic water supply line by means of a hose and, when the manual control lever of the valve means is in one swivelled position, connects the lifting device to the hydraulic water supply, so that the lift platform travels upwards; when the control lever is in the other swivelled position, it connects the lifting device to a discharge line, so that the lift platform travels downwards. When the manual lever is in a central position, the lift platform remains in its present position.

In the known lifting device, the angle of incline of the back rest is adjusted mechanically, a locking hinge being provided to permit the angle of incline of the back rest to be adjusted in fine steps.

SUMMARY OF THE INVENTION

The object of the invention is to improve the lifting apparatus in such a way that the control valve for the lifting device of the lift platform and a further control valve for an hydraulic swivelling device for the back rest can be integrated into a single control unit, that, irrespective of the lift platform, said control unit can be located in a position where it is easy for a helper to reach, and that the control unit is nevertheless small and handy in design.

This problem is solved in a lifting device of the type described at the beginning in that the valve means has a number of actuating valves, some of which are connected to an external manual control unit by means of a separate hydraulic control line in each case, said manual control unit being further connected to the housing of the valve means by means of an hydraulic water line and a discharge line, and that at least one of said actuating valves is connected to the lifting device via a pressure-tight hose and a further actuating valve is connected to the swivelling device by means of another hose of the same type.

The invention provides the advantage that all the working valves for admitting water to and discharging it from the lift platform, and also the swivelling device, are integrated in a housing which—as in the past—is attached to the lower side of the lift platform. A new development is that a preferably flexible multiple line is now connected to this housing, leading to a separate manual control unit which contains at least 4 servo valves ill order to be able selectively to actuate the working valves of the valve means at the lift platform.

The working valves of the valve means need to be relatively large in size in order to provide a sufficiently high flow of hydraulic water into the lifting device and the swivelling device, so that the adjustment procedures do not take too long. Small quantities of hydraulic water are sufficient to actuate said working valves, however, so that the servo valves in the manual control unit only need to be very small, and the control lines likewise only require a very small diameter. Thanks to the invention, the result is a very handy control unit, the dimensions of which are somewhat smaller than those of a conventional remote-control unit for a television set. Since the control lines manage with a diameter of only a few millimetres, they can be enclosed, according to one embodiment of the invention, in a protective jacket which is hardly thicker than the hose of a shower attachment.

The control unit can be hung up in a suitable position, e.g. on the bathroom wall, or it can be hung over the side of the bath. A handicapped person or a helper can pick it up easily. It is easy to keep an eye on the control buttons or levers, so that unintentional operating mistakes are out of the question. Thanks to the central valve block as the valve means, reliable functioning can be guaranteed. There are preferably two pairs of identical actuating valves fitted in the valve block, the inlet of one actuating valve being connected to the outlet of the other actuating valve of each pair of valves and also to a connection for one of the two hoses leading to the lifting device and to the swivelling device, whereas the outlet of one valve terminates in a housing outlet or a discharge line, and the inlet of the other valve is connected to the main hydraulic water supply line. The four working valves are thus partly connected together in the valve block by permanently positioned channels in the form of drilled holes, and to the outer connections. In principle, only four connecting couplings are required in the form of plug-in type or screw-type connections, viz. the hydraulic water supply connection, the connection for the lifting hose, the connection for the swivelling device, and the connection for the multiple line to the manual control unit.

One further embodiment of the invention consists in the fact that, in the pressure supply channel of the multi-valve housing, downstream of the branch of the hydraulic water feed line leading to the manual control unit and downstream of the inlet to the actuating valve admitting hydraulic water to the swivelling device, but upstream of the actuating valve admitting hydraulic water to the lifting device, a check valve is fitted which has an actuating tappet protruding from the multi-valve housing on a side wall, approximately parallel to the lift platform and co-operating with an actuator member operated by the guide frame of the lift platform in the raised position. This raised final cut-off, which is known per se and which prevents the lift platform from travelling higher than the raised position relative to the bathtub concerned, nevertheless makes it possible, thanks to the novel switching arrangement, remotely to control all the other functions, with the exception of further extending the lift platform. In particular, the angle of the back rest can be adjusted even when the lift platform is in the raised position.

A further embodiment of the invention can be seen in the fact that there are two manually operable discharge valves fitted into the multi-valve housing; on the inlet side, they communicate in each case with a channel leading to the hose connection for the swivelling or lifting device, and on the outlet side, they communicate in each case with a hole terminating at the outer side of the housing. It lies within the scope of the present invention to have, instead of the plurality of discharge openings on the housing, a single discharge channel in the housing, so that all the valves are drained at a common opening in the housing.

These discharge valves make it possible to drain the lifting and swivelling devices even when the multiple control line is not connected.

The multiple control line, which comprises at least four thin control hoses and a thin hydraulic water hose, the return flow occurring in the cavity between the common jacket and the five inside hoses, has a common coupling member on the valve housing side, which has at least six aperture elements releasably connected in a pressure-tight manner to corresponding apertures of a counter-coupling member, said counter-coupling member being attached to the outside of the housing, with its apertures on the inside of the housing communicating with the various working valves via a system of channels.

The at least four working valves in the multi-valve housing are all identical in design and are pre-tensioned into their closed positions by means of one built-in spring in each case. The valve bodies are connected to a piston or a membrane which delimits a pressure chamber in which one control line terminates in each case. The valves are only temporarily kept in the open position while hydraulic water is being admitted to the pressure chambers, and once no more hydraulic water is admitted, they return automatically to the closed position, it being ensured in the control unit that each control line is constantly connected either to the hydraulic water feed line or to the discharge line.

BRIEF DESCRIPTION OF THE DRAWINGS

The invention will now be described in more detail with reference to the drawing, which shows one embodiment.

DETAILED DESCRIPTION

Figure 1:
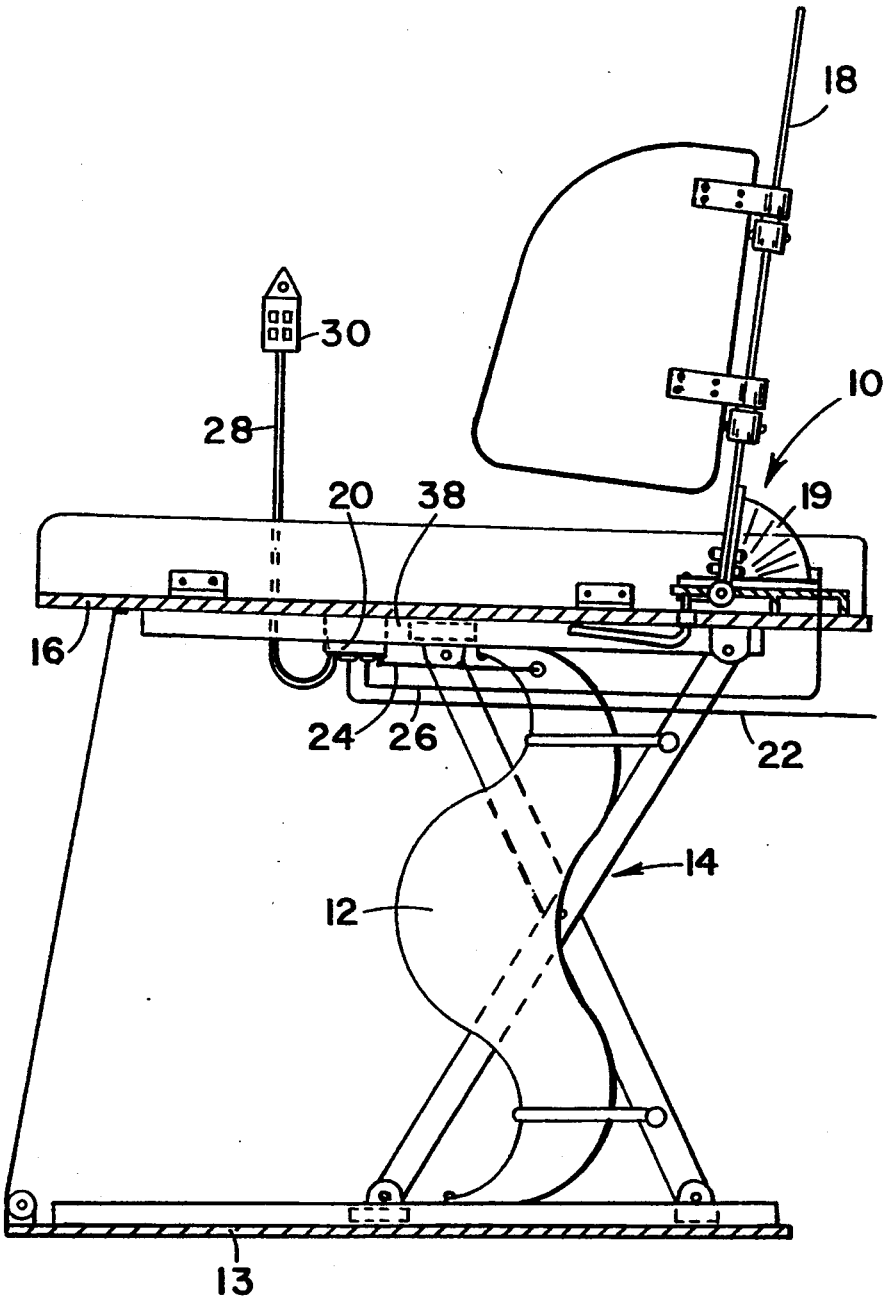
FIG. 1 is a view of the lifting apparatus with the lifting device, swivelling device, multi-valve housing, connection lines and a manual control unit.
Figure 2:
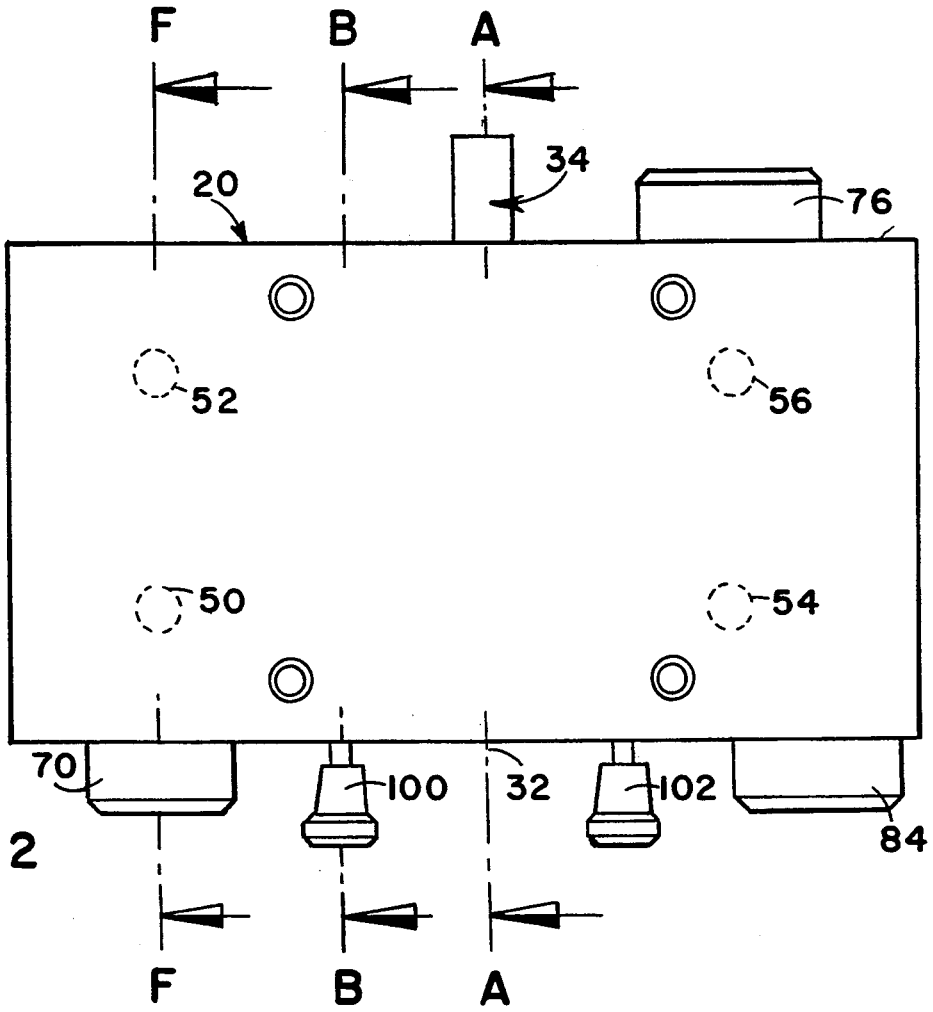
FIG. 2 is a view of the multi-valve housing from the top.
Figure 3:
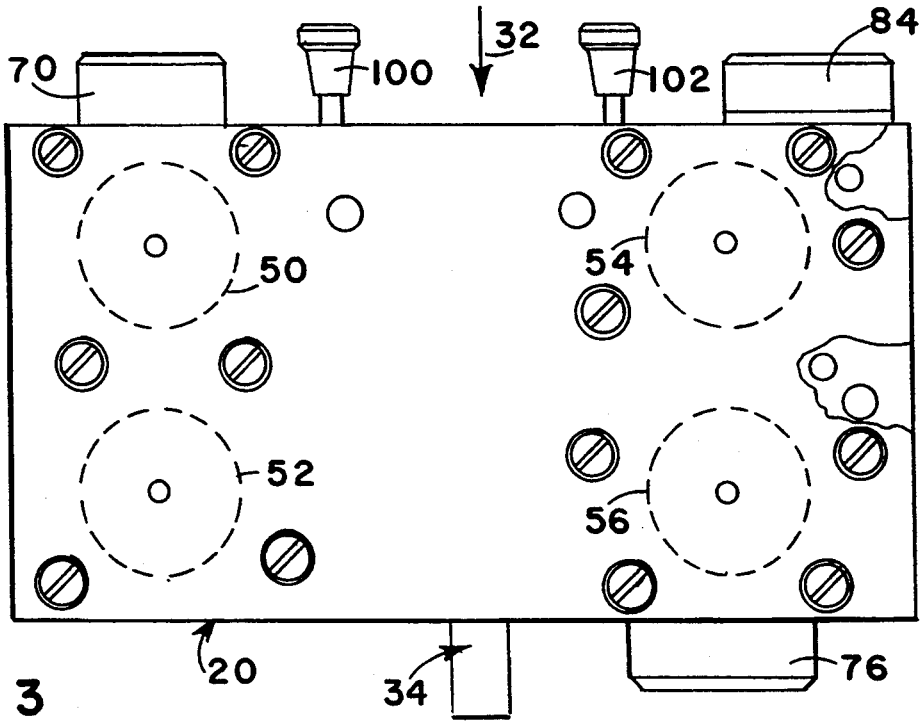
FIG. 3 is a view of the multi-valve housing from the bottom.
Figure 4:
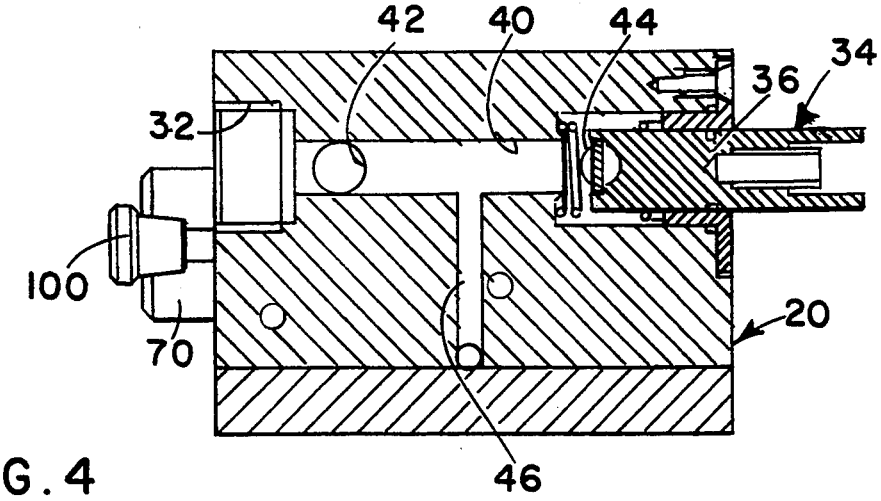
FIG. 4 is a sectional view through the multi-valve housing along the line A—A in FIG. 2.

A lifting apparatus 10 consists of a bottom mount or frame 13, with a guide frame 14 shaped like scissor arms disposed thereon and supporting a lift platform 16, a lifting device 12 in the form of a pressure-tight hose, closed at the end, being disposed between said lift platform 16 and said bottom frame 13. A back rest 18 is releasably mounted on the lift platform 16 by means of a swivel armature. An hydraulic swivelling means 19 serves to adjust the angle of said back rest 18.

Attached to the underside of the lift platform 16, there is a multi-valve housing 20 with an hydraulic water supply line 22, a connecting hose 24 leading to the lifting hose 12, a connecting hose 26 leading to the swivelling means 19, and a spiral cable 28 terminating there, and with a manual control unit 30 disposed at the end of said control line hose 28.

On its front side, the multi-valve housing 20 has an hydraulic water supply connection 32 with a coupling member of a rapid-action hose coupling screwed into it. Coaxially with said hydraulic water supply connection 32, there is a check valve 34 fitted on the rear of the multi-valve housing 20, the valve tappet 36 of which protrudes from the housing 20 and terminates in a fork serving to receive an actuator rod 38 (FIG. 1), which extends laterally on the lower side of the lift platform 16 and is supported in short slots in the rails on both sides for the arms of the guide frame 14. In the raised position of the lift platform 16 relative to the height of the bathtub concerned, the upper sliding members of the arms of the guide frame 14 in the rails of the lift platform 16 on both sides abut against the transverse rod 38 and displace it slightly, whereby the displacement works on the valve tappet 36 of the check valve 34 and seals off the hydraulic water supply channel 40 connected to the hydraulic water supply connection 32. Branching off from this longitudinal channel 40 are three transverse channels 42, 44, 46, the transverse channels 42, 46 being located upstream of the valve seat of the check valve 34, and transverse channel 44 being located downstream of said valve seat.

Inside the multi-valve housing 20, there are four identical valves 50, 52, 54, 56, which are perpendicular and whose axes form the corners of a square. Each of the valves 50–56 contains a multi-part displaceable valve body 58 with a washer 60 for resting against a valve seat of the multi-valve housing 20 and a membrane 62, with a spring 64 biasing the valve body 58 in the sealing position of the valve. The membrane 62 is anchored pressure-tight between a main body of the multi-valve housing 20 and a housing bottom plate, the membrane 62 delimiting a pressure chamber 66. When hydraulic water is admitted to the pressure chamber 66, the valve body 58 rises off the valve seat, and the transverse channel 42 communicates with a further longitudinal channel 68, which leads to a hose connection 70 on the front of the multi-valve housing 20. Connected to this connection 70 is the connecting hose 26 leading to the swivelling means 19.

The valve 52 serves to drain the swivelling means 19, which is why the longitudinal channel 68 leads to the hole in the valve body 58 of said discharge valve 52. Joining downstream of the sealing surface of this valve is an angled discharge channel 72, which terminates freely in an opening 74 on the rear of the housing.

Figure 8:
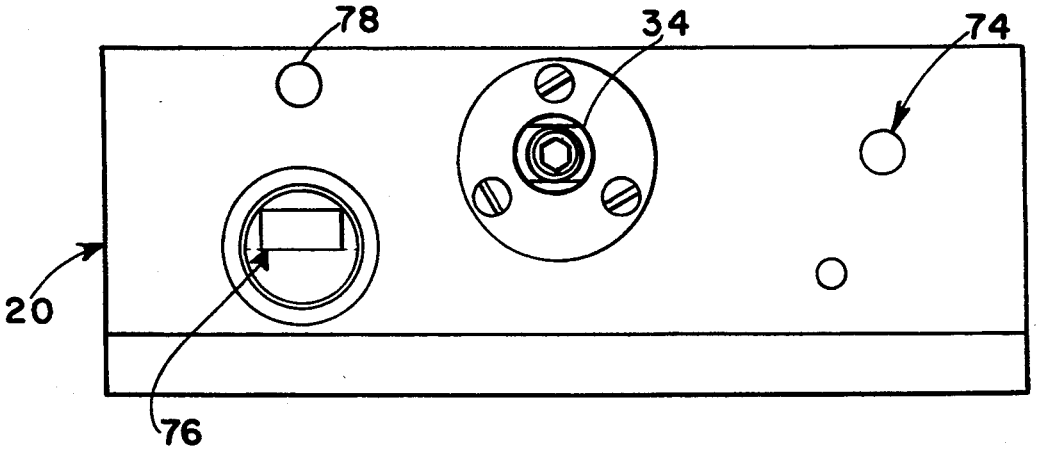
FIG. 8 is a view of the valve housing from the back.
Figure 9:
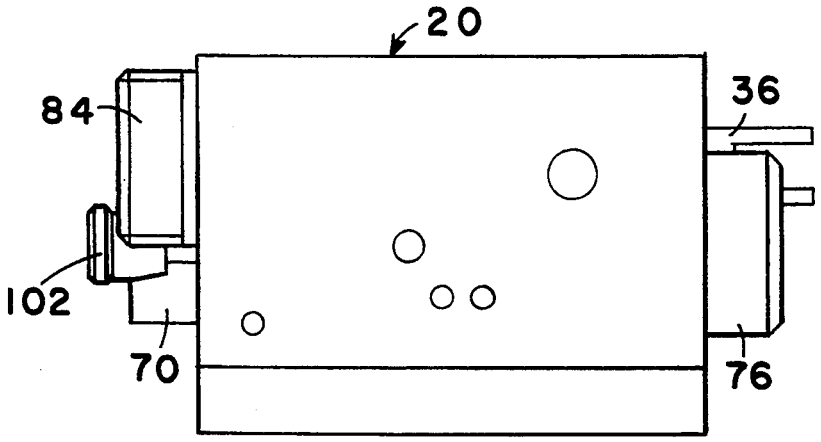
FIG. 9 is a view of the multi-valve housing seen from the left-hand side in relation to FIG. 8.
Figure 10:
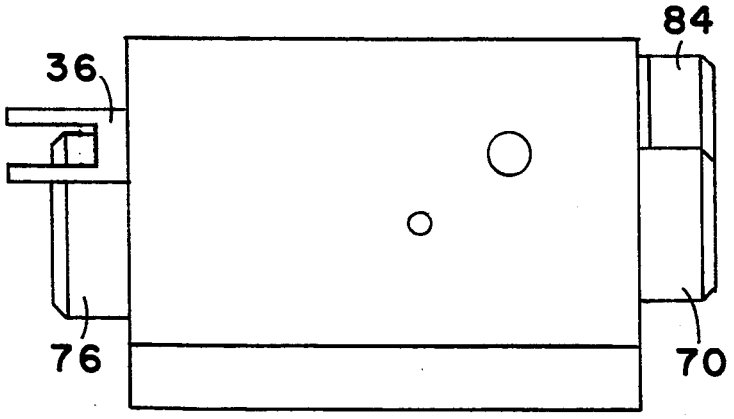
FIG. 10 is the opposite view from the right-hand side.

The two valves 54, 56 are connected to the hydraulic water supply channel 40 in the same way as the valves 50, 52, viz. via the transverse hole 44. When, therefore, valve 54 is opened, the hose connection 76 is connected to the hydraulic water supply channel 40, and water is admitted to the hydraulic water line 24 leading to the lifting device 12. If valve 56 is actuated instead, said hose connection 76 is drained via a drainage hole 78. The two drainage holes 74, 78 are located on the rear (FIG. 8) of the housing 20.

Figure 5:
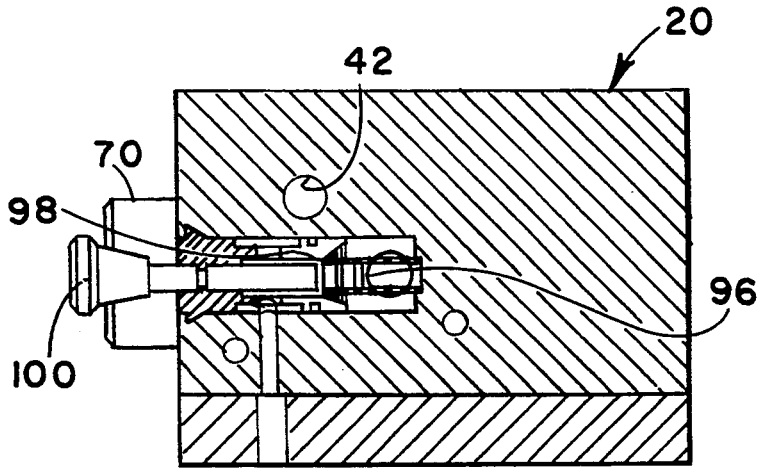
FIG. 5 is a sectional view along the line B—B in FIG. 2.
Figure 6:
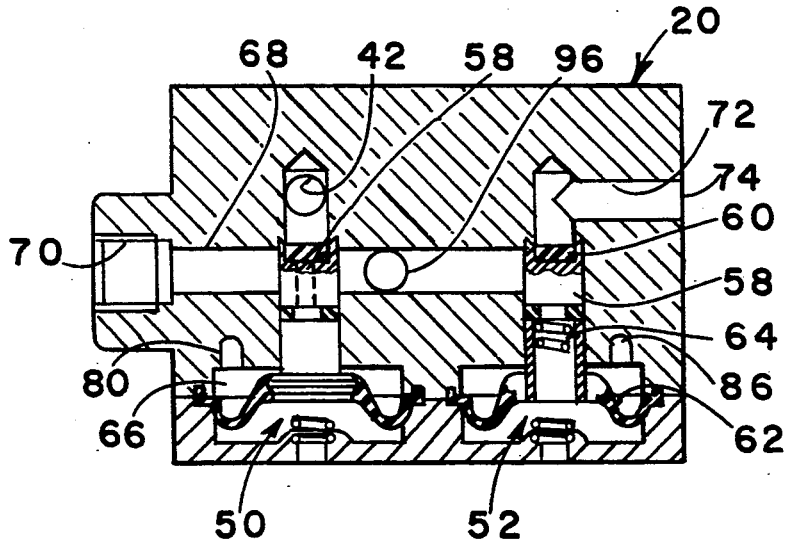
FIG. 6 is a sectional view along the line F—F in FIG. 2.
Figure 7:
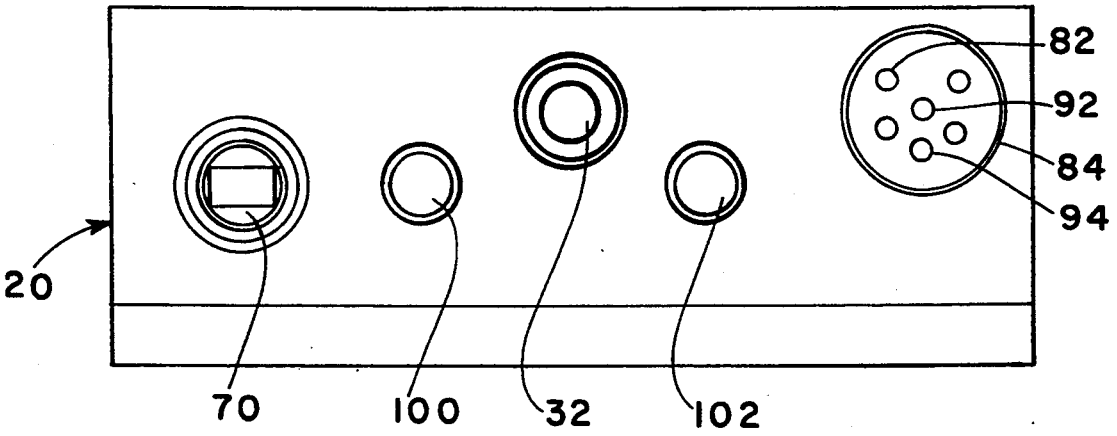
FIG. 7 is a view of the multi-valve housing from the front.
Figure 11:
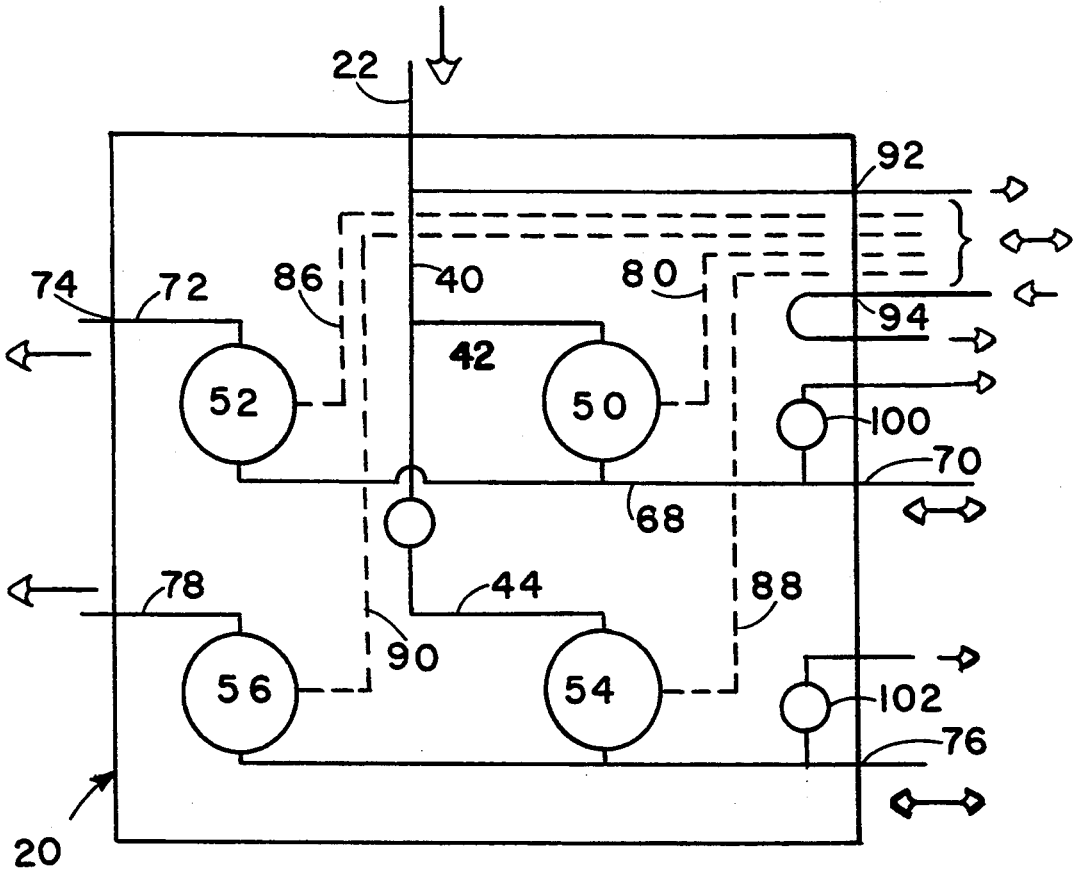
FIG. 11 is an hydraulic circuit diagram showing the channels in the multi-valve housing.

Terminating in the pressure chamber 66 of the valve 50 is a control channel 80, which leads to a hole 82 in a multiple connection 84 on the rear of the valve housing 20. In a similar way, the other pressure chambers of valves 52, 54, 56 are connected to said multiple connection 84 via corresponding control channels 86, 88, 90 (FIG. 11), the corresponding holes being arranged in parallel and spaced apart from one another. A central hole 92 of the multiple connection 84 is connected to the hydraulic water supply channel 40 via branch channel 46, and the hole 94 shown in FIG. 7 is connected to a U-shaped channel which terminates on the outside of the multi-valve housing. A coupling piece of the multiple-hose line 28 of the manual control unit 30 is attached to the multiple coupling connection 84, all five holes with the exception of hole 94 each being tightly connected to a thin pressure hose. For this purpose, the coupling piece has six protruding sleeves, which engage in the corresponding holes. Five hoses of the control line 28 are surrounded by a jacket, the interior cavity of which. is connected to the hole 94. As can be seen from FIGS. 5 and 6, the longitudinal channel 68 leading to the connection 70 for the swivelling means 19 of the back rest 18 is connected via a transverse channel 96 to a chamber of a discharge valve 98, which has a valve tappet 100. When the latter is actuated against the force of a restoring spring, the transverse channel 96 communicates with a discharge channel terminating at the bottom of the housing 20, and the hydraulic water of the swivelling means 19 can be discharged even if the manual control unit 30 is not connected. In the same way, the hose connection 76 leading to the lifting device 12 can be connected via a discharge valve 102 to a drainage aperture which is likewise located on the bottom of the housing. The control unit 30 has, for example, four buttons, which are operable against the pressure of a spring and which, when actuated, each adjust a servo valve in such a way that the corresponding control line is connected to the hydraulic water supply line. When the button is not pressed, the control line concerned is connected to the return flow, which means that it is pressure-free, in other words. When one of these four buttons on the manual control unit 30 is pressed, therefore, the associated working valve in the multi-valve housing 20 opens. Depending on the button selected, therefore, the lift platform 16 is raised or lowered, or the back rest 18 is swivelled forwards or backwards.

I claim:

1. A lifting apparatus (10) for handicapped persons, for insertion in a bathtub, comprising: a bottom frame (13); a lifting platform (16); a guide frame (14) connected between the lifting platform (16) and the bottom frame (13); a back rest (18) pivotably connected on the lifting platform (16); a hydraulic swivelling device (19) operatively connected to the back rest (18) for swivelling the back rest on the lifting platform (16); a hydraulic lifting device (12) connected to the frame and platform for raising and lowering the platform; valve means for activating the lifting and swivelling devices, the valve means having a multi-housing (20) with a plurality of working valves therein (50, 52, 54, 56); an external manual control unit (30) spaced from the housing; a separate hydraulic control line connected between each working valve and the control unit; a hydraulic water line and a discharge line connected between the manual control unit and the multi-housing; and at least one of the working valves being connected to the lifting device (12) via a pressure-tight hose (24) and a further working valve being connected to the swivelling device (19) by means of another pressure-tight hose (26) of the same type as the first-mentioned pressure-tight hose.

2. Lifting apparatus as claimed in claim 1, wherein there are two pairs of identical working valves (50, 52, 54, 56) fitted in the multi-valve housing (20), an inlet of one valve (52, 56) being connected to an outlet of the other valve (50, 54) of each pair of valves and also to a connection (70, 76) for one of the two hoses (24, 26), whereas the outlet (72, 78) of one valve (52, 56) terminates in a discharge line, and the inlet (42, 44) of the other valve (50, 54) is connected to a main hydraulic water supply line (22).

3. Lifting apparatus as claimed in claim 1, wherein the housing includes a pressure supply channel (40) and a hydraulic water feed line (46, 92) therein, leading to the manual control unit (30), the working valve (50) connected to the swivelling device (19) having an inlet (42), a check valve (34) fitted to the housing and having an actuating tappet (36) protruding from the mutli-valve housing (20) on a side wall thereof, approximately parallel to the lifting platform (16) and co-operating with an actuator member (38) operated by the guide frame (14) of a lifting platform (16) in a raised position thereof, the check valve being downstream of the hydraulic water feed line (46, 92), downstream of the inlet (42), and upstream of the working valve which is connected to the lifting device.

4. Lifting apparatus as claimed in claim 1, wherein said valves comprise two pairs of identical working valves (50, 52 and 54, 56) fitted in the multi-valve housing (20), with one valve (50, 54) of each pair of valves (50, 52 and 54, 56) forming an inlet valve and the other valve forming an outlet valve (52, 56), and all four valves (50–56) are arranged with parallel axes and the axes intersect the corners of a square.

5. Lifting apparatus as claimed in claim 4, wherein the outlet (68) of the inlet valve (50, 54) and the inlet (68) of the outlet valve (52, 56) are connected together and to a hose connection (70, 76) for the swivelling or lifting device (12, 19), the inlet (42, 44) Of the inlet valve (50, 54) is connected to a hydraulic water supply line (22) and the outlet (72, 78) of the outlet valve (52, 56) is connected to a hole (74) terminating on an outside of the housing (20), all the valves (5056) have a slide (58), each of which is biased in the closed position by a spring (64), said slide being connected to a membrane (62) delimiting a pressure chamber (66), and one of the control lines (80, 86, 88, 90) terminates in each of the pressure chambers (66).

6. Lifting apparatus as claimed in claim 1, including two manually operable discharge valves (98) fitted into the multi-valve housing (20) each with an inlet side communicating in each case with a channel leading to a hose connection (70, 76) for one of the swivelling and lifting device (12, 19), and on the outlet side, communicating in each case with a hole terminating at a outer side of the housing.

7. Lifting apparatus as claimed in the claim 1, wherein all the control lines, hydraulic water supply line and the discharge line are surrounded by a common jacket and are connected to a common coupling member on a side of the valve housing, which has a plurality of apertures equal to the number of lines surrounded by the common jacket, and the coupling member is releasably connected in a pressure-tight manner to a multiple connection member (84) disposed on the outside of the housing (20).

8. Lifting apparatus as claimed in claim 7, wherein the discharge line is outwardly delimited by the jacket.

9. Lifting apparatus as claimed in claim 1, wherein the control unit (30) is adapted so that each of the control lines is permanently connected to one of the hydraulic water supply line and to the discharge line.

10. Lifting apparatus as claimed in claim 1, wherein the axes of at least two of the working valves are in the same plane as the axis of at least one channel (68) in the housing leading to a hose connection (70, 76) of the lifting device.

* * * * *